United States Patent [19]

Dohn

[11] 3,972,530

[45] Aug. 3, 1976

[54] BOARD BASEBALL GAME

[76] Inventor: Walter R. F. Dohn, 210 Champagne Drive, Baie d'Urfe, Quebec, Canada

[22] Filed: Mar. 7, 1975

[21] Appl. No.: 556,320

[52] U.S. Cl. ..... 273/88; 273/93 R

[51] Int. Cl.[2] ..... A63F 7/06

[58] Field of Search ..... 273/88, 93 R

[56] References Cited

UNITED STATES PATENTS

| | | | |
|---|---|---|---|
| 840,584 | 1/1907 | Piper | 273/93 R |
| 1,084,618 | 1/1914 | Elliott | 273/93 R |
| 1,372,211 | 3/1921 | Waterstrout | 273/93 R |
| 1,532,066 | 3/1925 | 0'Connor | 273/93 R |
| 1,606,157 | 11/1926 | Ennisson | 273/93 R |
| 2,591,357 | 4/1952 | Hutchins | 273/88 |
| 2,769,639 | 11/1956 | Seale | 273/93 R |
| 2,886,319 | 5/1959 | Henderson | 273/93 R |
| 2,906,534 | 9/1959 | Davis | 273/88 |
| 2,998,975 | 9/1961 | Koch | 273/93 R |
| 3,372,933 | 3/1968 | Murzyn | 273/88 |

*Primary Examiner*—Richard C. Pinkham
*Assistant Examiner*—Harry G. Strappello
*Attorney, Agent, or Firm*—Alan Swabey & Company

[57] ABSTRACT

This board baseball game is so designed that the skill and strategy of a player can be utilized to the unique interrelation of pitch selection by the pitcher, batter location in the batter's box and position of the fielders, as well as the placement of the ball, if hit, on the playing field; thus providing a most true-to-life action baseball board game. The action is controlled by the players, by means of an unique method of openings in the home plate area which indicate the results of any pitch selection in comparison to the batter selection. These results are contained on an information wheel that is controlled by the pitcher.

8 Claims, 5 Drawing Figures

BOARD BASEBALL GAME

This invention relates to a board baseball game.

As it is well known, the game of baseball is getting more and more popular. Of course, as a game or sport increases in popularity, the public in general wants to be involved as much as possible with the game and not only as a spectator even without physically participating in the particular sport. This is the reason why we see so many miniature games such as baseball games, hockey games, football games, etc., on the market, which are designed not only for youngsters but also for adults. The game of baseball has a very specific characteristic — it is mostly a game of tactics and not of chance. For example, to our knowledge, all the baseball games which are on the market nowadays are based on chance, such as in the case of U.S. Pat. No. 3,105,688, issued on Oct. 1, 1963 to H. E. Gray.

Such types of games will of course be of some interest to children or young adults but surely lacks the necessary qualities, such as reliance on tactics which are the basis of a regular baseball game.

In order to overcome the above disadvantages, I have devised a new baseball game to be played by two teams, each formed of one or more persons, the baseball game comprising a game board, a baseball diamond drawn over the game board, two groups of miniature baseball players to be set at suitable locations on the baseball diamond, means enabling one of the two teams to select one type of pitch presumed to be delivered by the pitcher toward the hitter. The hitter not knowing the type of pitch delivered by the pitcher, means are provided whereby the team at bat records a decision made from anticipating the type of pitch, after which there is given an indication of the merits of the decision resulting from a comparison between the anticipating by the batter and the type of pitch thrown by the pitcher of the other team.

Of course, the baseball game preferably comprises an infield, and an outfield, the latter being made of a right field, a center field and a left field, all of which may be subdivided into square areas.

The square areas may for example be of three types and can be arranged as successive diagonally arranged rows of dark, dotted and clear square areas.

As in a standard baseball park, the game could comprise foul lines extending from home plate to corresponding left and right far corners, and numbers could be printed along the foul lines adjacent the square areas. Each number could identify lines running perpendicular to the foul lines.

It is, of course, preferable to have an infield which comprises a first base, a second base, a third base, a pitcher's mound, two on-deck circles, a plate subdivided into nine equal parts, a batter's box on both sides of the plate, the box being longitudinally subdivided into three portions, and a catcher's position behind the plate.

Preferably, the plate has a square shape and is generally subdivided into nine equal square parts which are numbered 1 to 9 inclusive.

The batter's box may have a longitudinal rectangular shape and each portion is preferably located opposite and is of the same size as a subdivided part of the square plate.

To make the game more interesting, there may be a wait or take square and even a bunt square which are both at the rear of the plate, between the plate and the catcher's position.

Openings could be formed into each part of the plate and a cover could be removably mounted in each of the openings.

More particularly, the baseball game could have a pitcher's window formed in the game board past the center field, an upstanding screen placed between the window and the center field to conceal the pitcher's window from a player of an opposite team who would be located behind the home plate, a wheel rotatably mounted underneath the game board, the wheel carrying a first set of signs corresponding to the types of pitches, the signs individually appearing through the window when rotating the wheel, the wheel also carrying a second set of signs, each sign adapted to appear through one opening of a part of the home plate after removing a corresponding cover.

The invention will now be illustrated by means of the following drawings in which.

Figure 2:
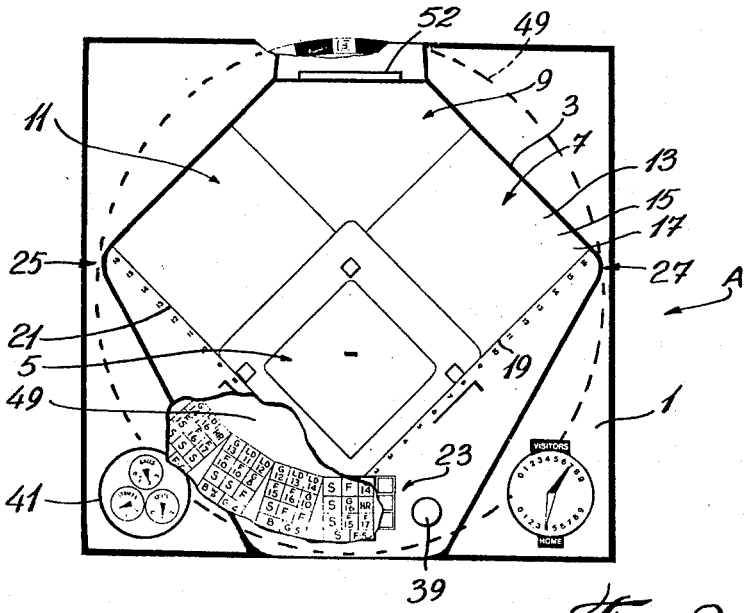
FIG. 2 is a similar view to FIG. 1 except that the game board is partially cut away to show signs carried by the wheel.

Referring to the drawings, the game A comprises a game board 1 on which there is drawn a baseball diamond 3 having the shape of a standard baseball park. Obviously, the shape can vary to any extent depending on the exact design of the board, etc.

Figure 4:
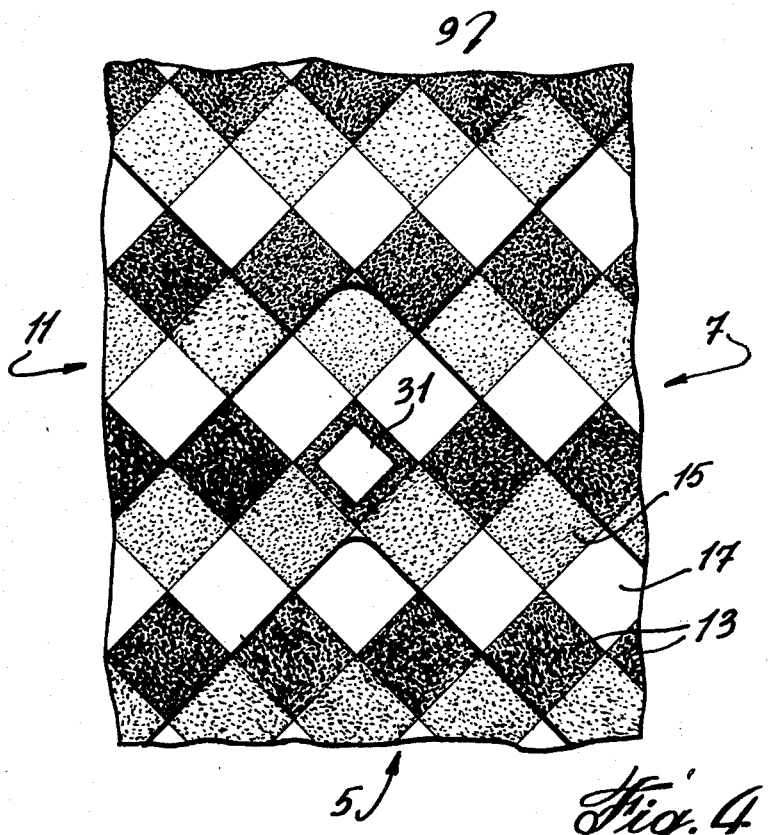
FIG. 4 is a blowup of a portion of the game board showing a portion of the infield and outfield region.

As illustrated, the baseball diamond 3 comprises an infield 5, a right field 7, a center field 9, and a left field 11, again all as in a standard baseball park. The area covered by the infield 5, and the outfield (right field 7, center field 9, left field 11) is formed with successive diagonally arranged rows of dark, dotted and clear square areas 13, 15 and 17 shown more clearly in FIG. 4.

Foul lines 19 and 21 extend from home plate 23 to corresponding left and right far corners 25, 27. Returning again to FIGS. 1 and 2, it will be realized that along each of the foul lines 19 and 21, the baseball diagram 3 has a column of reference numerals 2 to 16, each of the numbers being opposite a square 13, 15 or 17 of the baseball diamond to identify lines of square areas running perpendicular to the foul lines 19, 21. Obviously, the baseball diamond can be extended to any convenient size and in this case it will be obvious that it will contain more than reference numerals 2 to 16.

Turning now to the infield 5, the latter comprises a first base 29, a second base 31, a third base 33, and a pitcher's mound 35. In addition, suitably there are two on-deck circles 37 and 39, score boards 41 and 43 and first and third base coach boxes 45 and 47.

Finally, the baseball game according to the invention comprises a wheel 49 and a pitcher's window 51.

The home plate 23 is preferably square and is subdivided into nine equal square parts 55. On both sides of the plate 23 there are two batter's boxes 57, 59 which are longitudinally subdivided into three equal square portions 61 which include dark, dotted and clear squares similar to the squares 13, 15, 17, shown more clearly in FIG. 5.

Figure 1:
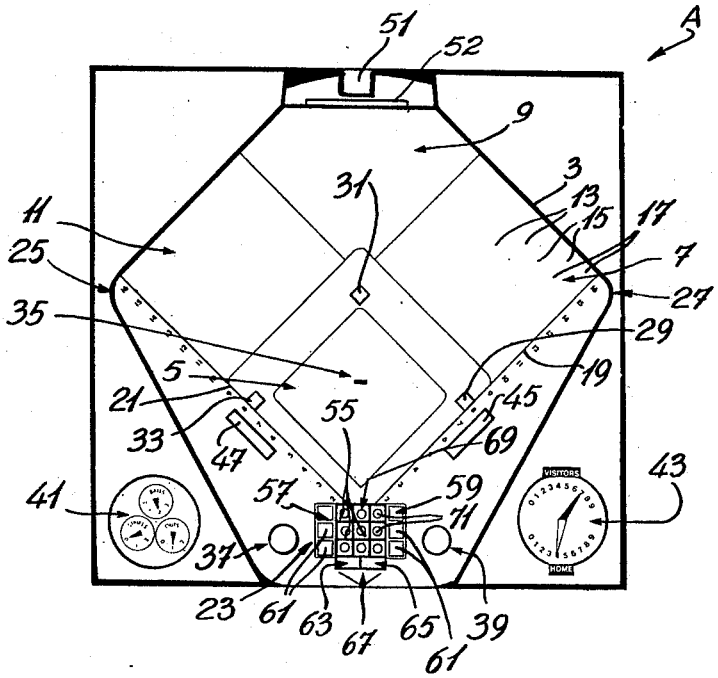
FIG. 1 is a schematic top view of the game.
Figure 5:
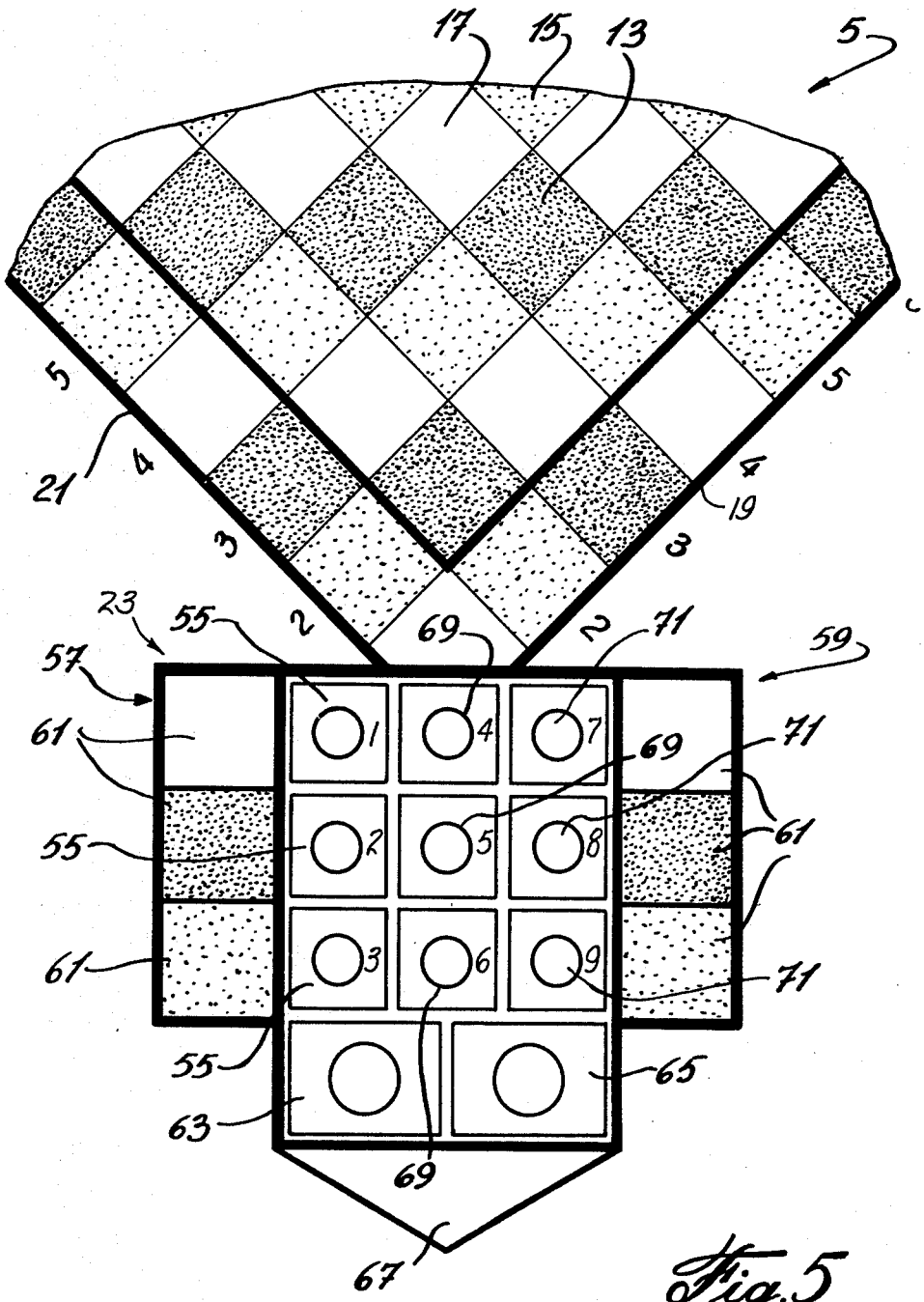
FIG. 5 is a blowup of a portion of the game board showing a portion of the infield and the entire home plate region.

Back of the plate 23, there is a wait or take square 63 and a bunt square 65 which are located side by side between the plate 23 and the catcher's position 67 all in the manner shown in FIGS. 1 and 5 of the drawings. Each subdivision 55 of the plate 23 is formed with an opening 69 which is covered by a removable cover 71 which is preferably ferromagnetic.

Figure 3:
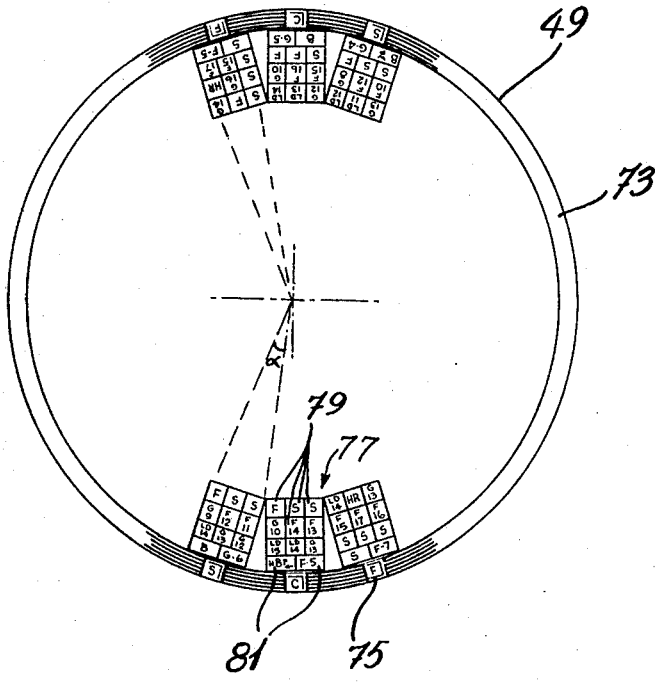
FIG. 3 is a schematic view of the wheel showing a series of signs.

Turning now to the wheel 49, shown in FIGS. 2 and 3 the latter will be seen to merely consist of a standard circular disc which has a diameter slightly shorter than one side of the square game board 1 and which is mounted underneath the game board 1 by means of a shaft (not shown) or any other known means to enable the wheel to be rotated by hand. An outer ring portion 73 of the wheel 49 comprises a regularly distributed series of signs for selecting a type of pitch, such sign being designed at will but preferably including letters such as S for slow ball, F for fast ball and C for curve ball. The following signs could correspond to areas 1 to 9 of each subdivision of the plate 53:

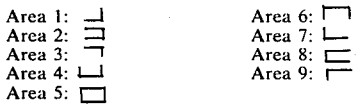

Of course, these signs can vary at will, the only requirement is that a particular one corresponds to a type of pitch which is directed to one particularly chosen area of the plate. A letter or symbol can be inside each sign, to indicate the type of pitch thrown over a particular area. Opposite each of these signs 75, which will now be called pitcher's frames, there are the same number of batter's frames 77 which appear on an imaginary ring inside ring portion 73. It will be noted that in the wheel which has been illustrated in the drawings, each frame subtends 13°20′ arcs in view of the number of frames; this can vary at will depending on the design of the wheel and the number of frames.

The batter's frames are subdivided into nine areas 79 corresponding to parts 55 and two areas 81 which correspond to the wait square 63 and the bunt square 65. Each of the areas 79 and 81 of the batter's frame 77 contains in abbreviated form or in any other representation, the result of a swing in a particular area after the pitch. For example, LD stands for line drive, HR stands for home run, G stands for grounder, B stands for ball, F stands for fly, *f* for foul, S stands for strike, WP for wild pitch, etc. The reference numerals indicate where the ball is hit.

Finally, to prevent the players of the team which is at bat from seeing the pitch selected by the team which is in the field, some kind of upstanding screen 52 or any other type of arrangement is mounted between the pitcher's window 51 and the end of the center field 9 which will conceal the pitch which has been selected.

The game can be played in the following manner. With two players, each player represents a team, the home team and the visiting team.

With three players, it will be the same as when the game is played with two players except that the third player will act as umpire and score keeper. After each game the umpire will be rotated.

With four players, each team will have two players. At bat, the players will alternate hitting. In the field, one player will be the pitcher, the other will place and move the fielders. Any variation of course is permissible.

To start the game the covers 71 for the windows 69 are positioned on home plate 23. The home team takes the field and miniature men are placed in their respective positions as follows:

Infielders: First, second and third basemen as well as shortstop may be placed on any square on the infield 5.

Outfielders: The right, center and left fielders are placed on any square in their respective fields 7, 9 and 11.

Pitcher: Position on the pitcher's mound 35.

Catcher: Position behind the home plate 53 at catcher's position 67.

The ball is positioned on the pitcher's mound. The bat which is preferably magnetic is positioned on the on-deck circle, which could be ferromagnetic in order to hold the bat while not in use.

The visiting team then places their first man to bat in any one of the three squares in the batter's box on either side of home plate. The squares are differentiated similarly as the field as "CLEAR", "DARK" and "DOTS". The square on which the batter is placed will determine the placement of the ball when hit.

The batter may not change his square after his initial placement. After the batter has been placed, "Play Ball" is called and the home team can then position their men to best defend against the batter. The defending team players can be positioned at any time before a pitch.

The pitcher then selects the type of pitch he wishes to throw by turning the wheel until the desired pitch is centered in the pitcher's window 51. There are three basic pitches that can be thrown: Fast ball, slow ball and curve ball. The game can, of course, be devised for many more types of other pitches. Each one of the above three pitches can be thrown over any one of the nine areas of the plate: they are as shown in the drawings, areas 1, 2 and 3 which cover the left side of the plate, areas 4, 5 and 6 which cover the center of the plate and areas 7, 8 and 9 which cover the right side of the plate. Areas 1, 4 and 7 represent letter high pitches, areas 2, 5 and 8 represent belt high pitches and areas 3, 6 and 9 represent knee high pitches.

The diagram in the pitcher's window accompanying a letter F, S or C allows the pitcher to determine where the ball is thrown. After the pitcher has called PITCH or THROW, the batter then has three options. He can:

1. "Swing" at one of the nine areas on home plate by lifting the cover of the area selected or "swung at";

2. Wait or take by lifting the ferromagnetic cover on the wait square using the magnetic bat; or 3. Bunt by lifting up the cover on the bunt square. A swing at an area, if it corresponds to the area where the ball was thrown will obviously result in a hit ball. The further away the swing from the area where the ball was thrown, the less effective the resulting hit until areas furthest away from the area pitched to will result in a complete miss or "strike, swinging".

4. After the batter has decided which area he will swing at, he lifts the area covered 71, reads out the result of his selection then replaces the area cover immediately.

If a STRIKE or FOUL (S or *f*) shows in the area selected then Strike 1 is recorded on the scoreboard.

If a HIT (L, G or F) shows in the area selected, then the batter will place the ball on the line indicated but it must be on the same type of square (clear, dotted or dark) as the square the batter had selected in the batter's box 61. That is, if the batter was standing on the dotted square in the batter's box, then the ball may be placed on ANY dotted square on the line to which the ball was hit. The above is subject to the following locations.

Any INFIELD hit can be placed on the line hit up to the square where the lines meet.

Any OUTFIELD hit must be placed in the field corresponding to the column selected. That is, any hit resulting from the lifting or selecting of squares 1, 2 or 3 will be placed in LEFT FIELD.

Hits from squares 4, 5 or 6 will be placed in center field.

Hits from squares 7, 8 or 9 will be placed in right field.

Note: As with the infield, hits to the CENTER FIELD will be placed on the line indicated, to the square where the lines meet and on the CLEAR, DOTTED or DARK square as indicated by the position of the batter in the BATTER'S BOX. Thus in the INFIELD and CENTER FIELD, a line extends inwards only to the square where it meets the same line number from the other side.

After the ball has been placed on the desired square by the batter, the defending team then has to field the ball. If the hit is a Line Drive — The defending player is allowed ONE move or square to field the ball.

Grounder — The defending player is allowed TWO moves.

Fly Ball — The defending player is allowed THREE moves.

Therefore, after the BATTER has placed the "ball" in the appropriate square, the defending team moves the man closest to the square in which the ball was placed, in order to field it. If he can reach the ball in the number of moves or squares allowed for the kind of hit shown, (or less than the allowed number) then the BATTER is out. The defending fielder can move right or left, up, down or diagonally — each new square entered counts as ONE move.

It will be seen that the above described baseball game most closely approximates the action in a real baseball game by reason of the following facts:

1. Board resembles an actual baseball field.
2. Players are placed in approximately the same positions as in a real baseball game.
3. The batter enters the batter's box on either side of the plate and in an advanced, middle or rear position in relation to the plate as in a real game.
4. The fielders can then shift their positions to best defend against the batter as in a real game.
5. Since the "STRIKE ZONE" can be divided into nine areas, to wit, high, middle and low inside — high, middle and low center — high, middle and low outside 5*a*. The pitcher can then "throw" a variety of pitches ("Fastball", "Slow Ball", "Curve", etc.) to a specific location over the plate ("High inside", "low outside") by means of the selection wheel 6. The batter then may elect to swing at the pitch, "take" the pitch or "Bunt" at the pitch as in a real game.

7. If the ball is "hit", it is in relation to how it would actually be hit in a real game, i.e., how far, and in what direction.
8. A ball hit would conform to the actual hit in that if the bat was swung below the area pitched then a "FLY" ball would result, swinging at a "ball" above the area pitched would result in a grounder. While a ball swung at on the same plane as the ball pitched would result in a "linedrive" as in a real game.
9. The result of the hit would depend on the position of the fielders in relation to where the ball was hit.
10. The further away the fielder is to the ball will result in a "safe hit", a "single", "double", "triple" or "homerun" as in real baseball.
11. The same strategy and mechanics that can be used in a real baseball game can be duplicated on this board game, such as "double plays", "squeeze bunts", "steal", "hit and run" and most other strategy moves.
12. This realism is possible because of the unique control that both offensive and defensive teams have over the play of the game.
13. Thus the game is decided in approximately these ratios: SKILL — 80%, LUCK — 20% which is close to the ratio of a real baseball game.
14. The board game closely follows real baseball action in that the play is not completed until the ball has been fielded.
15. Present baseball board games have possibilities limited by the comparatively few combinations pre-set on the board or by the throw of the dice. This game presents unlimited combinations as in a real baseball game.

It could also be said that the play of the baseball game according to the invention is controlled by the unique interaction of the pitcher's window and screen and of the wheel rotatably mounted underneath the game board coupled with the further play of the game as governed by the interrelation of the three distinctive squares on the baseball diamond and on the batter's box.

Of course the game can be subject to any variations of the above rules and other rules can be established.

I claim:

1. A baseball game to be played by two teams comprising:

a. a game board;

b. a baseball diamond drawn over said game board;

c. said baseball diamond comprising an infield and an outfield;

d. said infield comprising a first base, a second base, a third base, a pitcher's mound, a plate subdivided into nine equal parts having a first visual configuration and two adjacent parts having a second visual configuration, each of said parts formed with an opening therethrough, a batter's box on both sides of said plate, and a catcher's position located behind the plate;

e. said outfield comprising a right field, a left field and a center field;

f. a pitcher's window formed in said game board past the center field;

g. an upstanding screen placed between said window and said center field to conceal said pitcher's window from a player of an opposite team located behind said plate;

h. a wheel rotatably mounted underneath said game board;

i. said wheel carrying an outer ring of various types of pitch signs;

j. said various types of pitch signs individually appearing through said pitcher's window upon rotation of said wheel; and k. said wheel also carrying an inner set of signs, each set of signs adapted to appear through the openings located in said plate parts when a corresponding pitch sign, selected by the pitcher, is viewed in said pitcher's window.

2. A baseball game according to claim 1 wherein each of the nine equal parts of the plate is numbered 1 to 9 inclusive.

3. A baseball game according to claim 2 wherein each of said batter's box is longitudinally subdivided into portions, each portion thereof being located opposite and of the same size as a part of said plate.

4. A baseball game according to claim 3 wherein the two adjacent parts of the plate comprise a wait or take part and a bunt part positioned rearwardly of the nine equal parts of said plate between said plate and said catcher's position.

5. A baseball game according to claim 1 wherein the infield and outfield are both subdivided into visually distinguishable contiguous areas and wherein each of said batter's box is longitudinally subdivided into visually distinguishable portions, at least one of the portions of the batter's box being visually perceptible as identical to at least one of the contiguous areas on the baseball diamond, so constructed and arranged that the position selected by the batter on said batter's box is correlated to a type of area on said baseball diamond.

6. A baseball game according to claim 5, wherein the contiguous areas in both said infield and said outfield consist of diagonally arranged rows of visually distinguishable square areas.

7. A baseball game according to claim 6 wherein the contiguous square areas in both said infield and said outfield consist of diagonally arranged rows of dark, dotted and clear square areas.

8. A baseball game according to claim 1 wherein said infield also comprises two on deck circles, a first base coach box and a third base coach box.

* * * * *